US008048366B2

(12) United States Patent
Zhu et al.

(10) Patent No.: US 8,048,366 B2
(45) Date of Patent: Nov. 1, 2011

(54) PROCESS FOR MAKING COPPER TUNGSTEN AND COPPER MOLYBDENUM COMPOSITE ELECTRONIC PACKAGING MATERIALS

(75) Inventors: Dejun Zhu, Yixing (CN); Hong Wu, Yixing (CN); York Yuan Chang, Diamond Bar, CA (US); Ken Kuang, San Diego, CA (US)

(73) Assignee: Torrey Hills Technologies, LLC, San Diego, CA (US)

( * ) Notice: Subject to any disclaimer, the term of this patent is extended or adjusted under 35 U.S.C. 154(b) by 524 days.

(21) Appl. No.: 12/249,527

(22) Filed: Oct. 10, 2008

(65) Prior Publication Data

US 2010/0092327 A1 Apr. 15, 2010

(51) Int. Cl.
*B22F 3/26* (2006.01)

(52) U.S. Cl. ..... 419/27; 419/39

(58) Field of Classification Search ..... 419/27
See application file for complete search history.

(56) References Cited

U.S. PATENT DOCUMENTS 4,710,223 A * 12/1987 Matejczyk ..... 75/247

OTHER PUBLICATIONS

R.S. Khandpur, Printed Circuit Boards, Tata McGraw-Hill, published 2005, Chapter 9, pp. 365-368 and 378-379.*

O. Cakir et al. Chemical ethcing of Cu-ETP copper, Journal of Materials Processing Technology, 162-163 (2005), pp. 275-279.*

* cited by examiner

*Primary Examiner* — George Wyszomierski
*Assistant Examiner* — Mark L Shevin

(57) ABSTRACT

From tungsten or molybdenum powders, a tungsten or molybdenum compact is pressurized and molded into the same dimensions as or slightly larger than the end product and sintered into tungsten or molybdenum skeleton. After copper infiltration, chemical copper etching is applied to remove excess surface copper. A machining allowance with an absolute value >0-≦0.1 mm may be applied for the machining of uneven surfaces resulting from the chemical process of copper removal.

10 Claims, No Drawings

PROCESS FOR MAKING COPPER TUNGSTEN AND COPPER MOLYBDENUM COMPOSITE ELECTRONIC PACKAGING MATERIALS

BACKGROUND OF THE INVENTION

1. Field of the Invention

The present invention relates to a new process for making copper/tungsten and copper molybdenum composite packaging materials, and more specifically, to a chemical copper removal process that improves manufacturing and material utilization efficiency tremendously.

2. Description of the Prior Art

Copper/tungsten and copper molybdenum composites, preserving tungsten and molybdenum's characteristic of low thermal expansion and copper's high thermal conductivity, have been widely used in the packaging of microwave devices, optoelectronic components, integrated circuits, and many other electronic packaging applications. Their measures of thermal expansion coefficient, thermal conductivity, and electrical conductivity can easily be controlled by varying copper/tungsten and copper/molybdenum ratios. They can also be matched with semiconductor silicon, arsenic, gallium arsenide, aluminum oxide and beryllium oxide, etc.

Since tungsten, molybdenum and copper have considerably different melting points, it is impossible to melt W and Cu into each other at high temperatures. In other words, no eutectic will be formed. Therefore, copper/tungsten and copper/molybdenum composite material can only be fabricated through powder metallurgy. At present, there are three major techniques: infiltration, high-temperature liquid phase sintering, and activated liquid phase sintering.

Infiltration

In this technique, tungsten and molybdenum powder are mixed with a small amount of binders, pressurized and molded into a tungsten or molybdenum compact, and then sintered into a tungsten and molybdenum skeleton. Designed excess copper is thereafter attached to the surfaces of the tungsten and molybdenum skeleton and infused into the tungsten and molybdenum skeleton at temperature higher than the melting point of copper (typically 1350° C.). Precision machining will then be performed to get the desired dimensions.

An example can be found in U.S. Pat. No. 2,179,960, issued in 1939. Internationally, an example can be found in Chinese patent CN1995438, the disclosure of a process for making copper/tungsten and copper/molybdenum composites through sintering tungsten and molybdenum powder into a skeleton which is then infiltrated with molten copper.

An advantage of this technique is that during the process of infiltrating copper into the tungsten and molybdenum skeleton, most of the voids and interstices between the sintered tungsten or molybdenum particles can be filled by copper and hardly any eutectic develops. Therefore, critical measures such as hermeticity and thermal conductivity are ideal, especially the thermal conductivity, which can reach 180-200 W/mK.

The disadvantage associated with this method is that, for each and every piece of copper/tungsten and copper/molybdenum composite, thickness of the copper infiltration overflow is unpredictable and inconsistent. To facilitate precision machining, the tungsten or molybdenum skeleton needs to be at least 0.8 mm extra in thickness than the finished product. Machining allowance has to be even bigger when machining parts with mounting holes, steps, pedestals, slot and other 3D features to their desired shapes. The result is a decrease in efficiency and vast waste of tungsten or molybdenum, which sometimes accounts for 80% of the final composite and is a few times more expensive than copper. Compared to high temperature liquid phase sintering and activated liquid phase sintering, this method causes 10-45% more waste of materials. It is the most expensive technique of all considering the material and manufacturing costs, especially for irregular shaped products.

High-Temperature Liquid Phase Sintering

First, tungsten or molybdenum powders and copper powders are mixed to the designed proportion. The mixture is then pressurized and molded into compacts 0.2-0.3 mm larger in every dimension than the final product, after which it is sintered at temperature higher than 2000° C. To obtain the desired product dimensions, precise machining is performed to remove the excess copper.

An example can be found in U.S. Pat. No. 5,686,676, in which the sinterability of a copper/tungsten green compact is improved by using copper oxide, tungsten oxide or both as the copper and/or tungsten source. Sinterability is further enhanced by including steam in the sintering atmosphere.

Another example can be found in U.S. Pat. No. 6,589,310, in which the sinterability is further improved using phosphorous as sintering aid.

An advantage of this method is the efficient use of expensive tungsten, since the machining allowance will be much smaller than required by the infiltration method. It has its drawbacks, too. First, sintering temperature is high, which makes this process costly.

Sintering cost takes up the biggest proportion of total cost after material cost. Second, high temperature sintering leads to the formation of eutectic, which reduce the hermeticity and thermal conductivity of copper/tungsten and copper/molybdenum composites, the two properties that affect the reliability of integrated circuits. Thermal conductivity of final product attained by this method is only 180-190 W/mK. Finally, precise machining surface by surface and piece by piece increases complexity of manufacture and cost. It is especially the case for the fabrication of irregular shaped packaging materials.

Activated Liquid Phase Sintering:

This technique is developed to lower the temperature requirements by high-temperature liquid phase sintering. Chemical activators such as nickel, cobalt and copper oxide are included in the liquid phase sintering process. This action makes eutectic form at a lower temperature, thus reducing the temperature requirements for sintering.

Although activated liquid phase sintering lowers the sintering temperature to around 1600° C., the decrease is not significantly different from what is required by high temperature liquid phase sintering technique. Not only does it not eliminate disadvantages associated with the other manufacturing techniques, but the use of sintering activators increases the quantity of eutectics that may cause micro pores on some parts. Thus, parts produced by this technique have even lower hermeticity and thermal conductivity than those produced by high temperature liquid phase sintering. The thermal conductivity attained by this technique is only 50-170 W/mK.

Additional prior art related to this invention can be found in U.S. Pat. Nos. 343,875, 3,440,043, 3,969,754, 4,153,755, 4,158,719, 4,168,719, 4,196,442, 4,430,124, 4,451,540, 4,500,904, 4,672,417, 4,680,618, 4,736,883, 4,752,334, 4,788,627, 4,988,386, 5,009,310, 5,039,335, 5,049,184, 5,086,333, 5,099,310, 5,379,172, 5,379,191, 5,380,956, 5,386,143, 5,386,339, 5,387,815, 5,409,864, 5,413,751, 5,439,638, 6,589,310, 6,914,032, 7,063,815, 7,122,069 and 7,172,725.

All of the above techniques for manufacturing copper-tungsten composite packaging materials have their drawbacks. Extensive machining is the only way adopted by existing technologies to remove the excess copper. The amount of copper infiltration, molding shrinkage, and machinery process may cause 0.2-0.8 mm loss in size for the final product. In summary, the manufacturing efficiency has been low and the share of processing cost high, especially when fabricating products with mounting, holes, slots, pedestals and other irregular shapes.

Accordingly, there is a need for a new process for making copper/tungsten and copper molybdenum composite electronic packaging materials that reduces the complexity and cost of manufacture.

SUMMARY OF THE INVENTION

In accordance with the present invention, it has been discovered that copper/tungsten and copper molybdenum composite packaging material can be produced by sintering a tungsten or molybdenum compact into a tungsten or molybdenum skeleton, infiltrating the sintered skeleton with copper, and then chemically removing the excess copper rather than mechanical machining.

In accordance with a preferred embodiment of the invention, it has been found that the tungsten compact can be pressurized and molded in the same dimensions as the desired final product.

In accordance with another preferred embodiment of the invention, it has also been found that to further ensure precision, a machining allowance with an absolute value >0-≦0.1 mm can be applied for the machining of uneven surfaces, which may have been caused by the chemical process of copper removal.

In a still further preferred embodiment of the invention, it has been further found that chemical copper removal can be accelerated with the chemical solution heated to a temperature higher than the ambient temperature, e.g., 40-50° C., and pressure-sprayed to the parts.

DETAILED DESCRIPTION OF THE INVENTION

The primary objective of this invention is to overcome the technical disadvantages of the prior art and to provide an innovative copper/tungsten and copper molybdenum composite packaging material manufacturing technique with small machining allowance, high manufacturing efficiency and better utilization of raw materials.

To achieve this objective, a tungsten or molybdenum skeleton, in the same dimension as the desired final product or slightly larger, is attained through pressurizing and molding before it is infiltrated with copper. After copper infiltration, a chemical process is applied to remove the excess copper, thereby overcoming the disadvantages of the prior art. More specifically, this copper/tungsten and copper/molybdenum composite packaging material manufacturing method contains the following steps:

1) Pressurizing and molding tungsten powder into tungsten or molybdenum compact the same size as the final product;
2) Sintering tungsten or molybdenum compact into tungsten or molybdenum skeleton;
3) Infiltrating tungsten or molybdenum with copper in pre-designed amount at temperature higher than the melting point of copper;
4) Using a chemical solution to remove excess copper on product surfaces after infiltration.

Details of the inventive process are discussed below.

Tungsten or Molybdenum Skeleton

The technology of making tungsten or molybdenum skeleton in this invention is similar to the existing ones. Pure tungsten or molybdenum powder and binders are mixed and this mixture is pressurized and molded into a compact with the same dimensions as the end product. Another way is to use copper-plated tungsten or molybdenum powder directly and have it molded into desired compact. Such compacts are thereafter sintered into green tungsten or molybdenum skeleton.

Copper Infiltration

The process of copper infiltration is also similar to the existing processes. Sintered tungsten or molybdenum skeleton is contacted with molten copper and copper is infused into the inter-particle spaces of tungsten or molybdenum. The proportion of tungsten or molybdenum to copper can be adjusted to match the desired thermal expansion characteristics of microwave devices, optoelectronic components, integrated circuits, etc.

Chemical Removal of Copper

The chemical copper removal technology in this invention utilizes a chemical solution that will only etch copper but not tungsten or molybdenum to remove the excess copper on the surfaces of the tungsten or molybdenum skeleton. Replacing the precision machining method, this invention achieves higher manufacturing efficiency and minimizes waste of the expensive tungsten or molybdenum material. Any chemical solution that etches copper but not tungsten or molybdenum, for example, but not limited to, ferric chloride solution, and many other kinds of acid, alkali and other chemical solution, can be used in this technique.

Chemical removal of excess copper may cause micro-scale uneven surfaces to the final product. It may also cause air blisters during the process of nickel sintering after electroplating. To avoid the above problems that may affect the quality of the finished product, this invention applies a surface machining allowance, with an absolute value >0-≦0.1 mm (positive tolerance for dimensions and negative tolerance for mounting holes, slots and other 3D features).

In order to accelerate the chemical removal of copper, chemical solution is heated to a temperature higher than ambient temperature, e.g., 40-50° C., and then pressure-sprayed to increase the speed of etching.

Unlike the present technologies, this copper/tungsten and copper molybdenum composite packaging material manufacturing method uses chemical copper removal instead of mechanical machining to remove excess copper and there is no shrinkage during the process of pure tungsten or molybdenum compact sintering. Furthermore, the chemical copper removal solution does not etch tungsten or molybdenum, which means tungsten or molybdenum compact can be formed in the same dimensions as the final product. To further ensure precision, this invention applies a machining allowance with an absolute value >0-≦0.1 mm for the machining of the uneven surfaces, which may have been caused by the process of copper removal.

Since this invention does not require the onerous machinery process that removes excess copper, it improves production efficiency significantly, about 30% higher than liquid phase sintering and at least 70% higher than infiltration. Furthermore, this invention reduces the waste and thereafter the consumption of expensive tungsten or molybdenum materials during the machining process, 10% compared to the liquid phase sintering and at least 80% compared to infiltration.

To sum up, overcoming the disadvantages associated with the prior art, this invention relates to a new copper/tungsten composite packaging material manufacturing technique that reduces complexity of manufacture and cost. This technique is especially suitable for mass production, and especially of irregular shaped, with mounting holes, slots, pedestals and recesses products. The hermeticity tightness and thermal conductivity of the final product are similar to those in the technique of infiltration. The thermal conductivity, for example, is measured at 180-200 W/mK.

WORKING EXAMPLES

To further illustrate this invention, two examples are described in details below. These two examples do not cover all the technologies under the concept of this invention. They are only meant to describe the principle of this invention, but in no way to limit the claims. Any changes, variations, modifications to this invention are all retained to be protected by this invention as long as the changed ones share the same technical features and effects as this invention.

Example 1

This example is designed to manufacture 25 mm*25 mm*1 mm final product. Pure tungsten or molybdenum powder is mixed with 0.3-0.8 wt % stearic acid and then pressurized and molded into 25.1 mm*25.1 mm*1.1 mm pure tungsten or molybdenum compact. The tungsten or molybdenum compact goes through a binder burn-out under 900° C. in reducing atmosphere, then sintered to get a tungsten or molybdenum skeleton.

Designed excess copper (~5% extra) copper sheet is covered on one side of the tungsten or molybdenum skeleton. And in 1350° C. the copper is melted and infiltrated into tungsten or molybdenum skeleton. Ferric chloride, a copper removal solution and preheated to 45° C., is pressure-sprayed on the post infiltration products to remove the excess copper. As the last step, precision machining is performed to attain the desired dimensions of final product, which is 25 mm*25 mm*1 mm.

Example 2

To manufacture the same 25 mm*25 mm*1 mm final product, follow similar steps as in Example 1, except for the formation of tungsten or molybdenum compact. In this example, copper-plated tungsten or molybdenum powder is pressurized and molded directly into tungsten or molybdenum compact.

CLAIMS

Any variations, substitutions based on the principle of this invention described, common sense, or current known technologies are all retained to be protected by the following claims. Variations, and therefore falling within the protection of this patent include, for example, but not limited to, applying other types of tungsten or molybdenum compact shaping binders, with mounting holes, pedestals and recesses or using negative tolerance machining allowance.

For the purpose of illustration, terms "chemical removal of copper" and "chemical etching of copper" are used interchangeably.

What is claimed is:

1. A process for producing a copper/tungsten or copper/molybdenum composite packaging end product, said process comprising the following steps:

pressurizing and molding a tungsten or molybdenum powder mixture into a tungsten or molybdenum compact, sintering the tungsten or molybdenum compact into a tungsten or molybdenum skeleton, infiltrating about 5% excess of copper into the tungsten or molybdenum skeleton, and chemically removing excess surface copper to produce the copper/tungsten or copper/molybdenum composite packaging end product.

2. The process of claim 1, wherein said tungsten or molybdenum powder mixture further comprises a binder.

3. The process of claim 1, wherein said tungsten or molybdenum powder mixture is a copper-plated tungsten or molybdenum powder mixture.

4. The process of claim 1, wherein said tungsten or molybdenum powder mixture is pressurized and molded into a tungsten or molybdenum compact that is the same size as or slightly larger size of the copper/tungsten or copper/molybdenum composite packaging end product.

5. The process of claim 4, wherein the tungsten or molybdenum compact is ≦0.1 mm larger in every dimension than the copper/tungsten or copper/molybdenum composite packaging end product.

6. The process of claim 1, wherein said copper is infiltrated into the tungsten or molybdenum skeleton at a temperature higher than the melting point of copper.

7. The process of claim 1, wherein the chemically removing excess surface copper step comprises using a chemical copper removal solution that only etches copper but not tungsten or molybdenum.

8. The process of claim 7, wherein the chemically removing excess surface copper step comprises heating said chemical copper removal solution to a temperature higher than ambient temperature and then pressure-spraying said heated chemical copper etching solution on said tungsten or molybdenum skeleton.

9. The process of claim 8, wherein said chemical copper removal solution is heated to 40-50° C.

10. The process of claim 7, wherein said chemical copper etching solution comprises ferric chloride.

* * * * *